United States Patent [19]

Lucisano

[11] Patent Number: 4,842,489

[45] Date of Patent: Jun. 27, 1989

[54] HAND-OPERATED PUMP CHANGEABLE FROM DUAL ACTION TO SINGLE ACTION

[76] Inventor: Francesco Lucisano, Via Ronchi, 39, Milan, Italy

[21] Appl. No.: 33,667

[22] Filed: Apr. 3, 1987

[30] Foreign Application Priority Data

Apr. 4, 1986 [IT] Italy ..... 21427/86[U]

[51] Int. Cl.[4] ..... F04B 21/04; F04B 19/00

[52] U.S. Cl. ..... 417/238; 417/314; 417/526

[58] Field of Search ..... 417/238, 525, 526, 527, 417/528, 534, 305, 441, 306, 236, 314, 437, 260; 220/375; 91/34

[56] References Cited

U.S. PATENT DOCUMENTS

| | | | |
|---|---|---|---|
| 419,197 | 1/1890 | Hill | 417/238 |
| 767,092 | 9/1904 | Walker et al. | 417/238 |
| 1,301,751 | 4/1919 | Scanlan | 417/314 |
| 1,697,734 | 1/1929 | Quandt, Jr. | 417/314 |
| 1,738,734 | 12/1929 | Scoville | 417/314 |
| 2,445,127 | 7/1948 | Schwenk | 417/437 X |
| 4,508,490 | 4/1985 | Ramirez et al. | 417/238 |

FOREIGN PATENT DOCUMENTS

| | | | |
|---|---|---|---|
| 2005339 | 9/1970 | Fed. Rep. of Germany | 417/526 |

*Primary Examiner*—Carlton R. Croyle
*Assistant Examiner*—Leonard P. Walnoha
*Attorney, Agent, or Firm*—Robbins & Laramie

[57] ABSTRACT

The invention provides a hand-operated pump for fluids in general, which comprises a body inside which a cylindrical hollow is provided, inside which a plunger is slidingly mounted, such a plunger dividing said hollow into a first variable-volume chamber and a second variable-volume chamber, said pump comprising unidirectional valve means which control the intake of fluid from the outside into said chambers, and the delivery of fluid from said chambers to the outside, said plunger being suitable to be reciprocatingly driven by means of an outer handle according to a to-stroke during which the handle is taken away from the pump's body, during said to-stroke fluid being intaken from the outside into the second chamber, and fluid being delivered from the first chamber to the outside, and according to a fro-stroke, during which the handle is approached again to the pump's body, during said to-stroke fluid being intaken from the outside into said first chamber, and fluid being delivered from the second chamber to the outside, said body being provided, in correspondence with the end of said first chamber, with a passage tightly closed in an openable way.

12 Claims, 4 Drawing Sheets

HAND-OPERATED PUMP CHANGEABLE FROM DUAL ACTION TO SINGLE ACTION

The object of the present invention is a hand-operated pump for fluids in general.

Double-acting, hand-operated pumps are known, which comprise a body provided with a support basis, and provided with an inner cylindrical chamber, inside which a plunger is slidingly mounted, which can be actuated by means of an outer handle provided in an opposite position relatively to the basis of the body.

Such pumps are provided with suitble valve elements and suitable ducts, which allow a fluid delivery to be obtained both in the to-stroke and in the fro-stroke of the reciprocating plunger.

For performing the pumping, the operator, by fastening by his feet the support basis, and hence the body, on the pump, on the support plane, reciprocates the plunger by acting on the handle.

The to-stroke of the plunger corresponds to a pulling action by the operator, i.e., to an action of taking the handle away from the pump's body, whilst the fro-stroke of the plunger corresponds to a pushing action by the operator, i.e., to an action of approaching the handle to the body of said pump.

Such pumps are very advantageous in as much as they allow a considerable flowrate of fluid to be achieved during a time unit.

They show however to be not much advantageous when the pumping action must be performed against a high delivery pressure.

In fact, during the fro-stroke, the operator can take advantage of his own bodyweight to apply the necessary strong thrust to the plunger. During the to-stroke, on the contrary, performed by operating in the pulling mode, the operator must exclusively use his muscular strength and the task is hence much more fatiguing.

At certain pressure levels, even if it is possible for the operator, by precisely explointing his own weight, to move the plunger in the direction of the fro-stroke, and hence pump the fluid towards the use point, as a matter of fact the pump cannot be used, because the necessary strength for lifting the plunger to its position of fro-stroke beginning is higher than the operator's muscular strength.

Purpose of the present invention is to propose a hand-operated pump of the above disclosed type, so designed as to overcome the above-said drawback.

Such a purpose is achieved by means of a hand-operated pump for fluids in general, comprising a body inside which a cylindrical hollow is provided, inside which a plunger is slidingly mounted, such a plunger dividing said hollow into a first variable-volume chamber and a second variable-volume chamber, said pump comprising unidirectional valve means which control the intake of fluid from the outside into said chambers, and the delivery of fluid outwards from said chambers, said plunger being suitable to be reciprocatingly driven by means of an outer handle according to a to-stroke during which the handle is taken away from the pump's body, during said to-stroke fluid being intaken from the outside into the second chamber, and fluid being delivered from the first chamber to the outside, and according to a fro-stroke, during which the handle is approached again to the pump body, during said to-stroke fluid being intaken from the outside into said first chamber, and fluid being delivered from the second chamber to the outside, said body being provided, in correspondence with the end of said first chamber, with a passage tightly closed in an openable way.

Hereunder a disclosure is supplied of an exemplifying form of practical embodiment of the present invention, illustrated in the hereto attached drawing tables, wherein.

Figure 1:
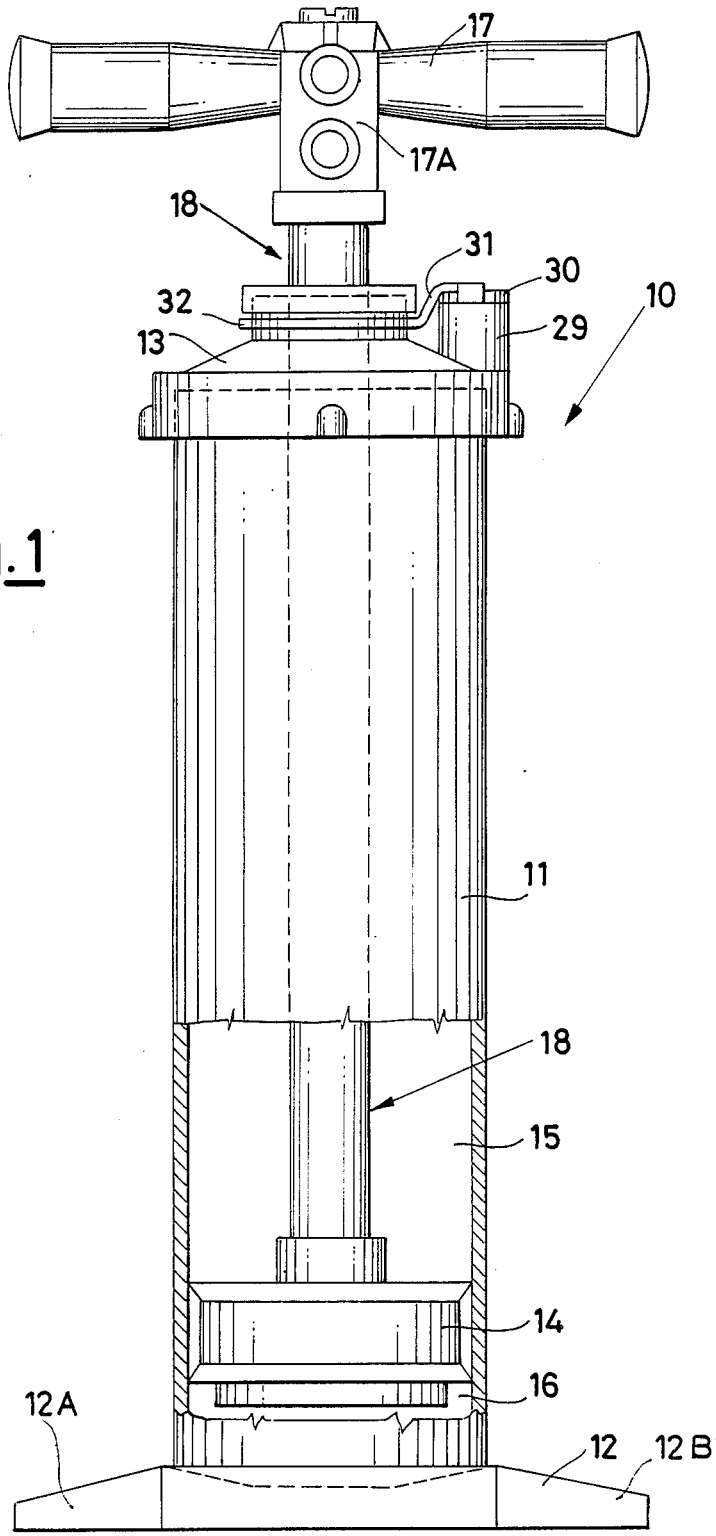
FIG. 1 is a partly sectional elevation view of a hand-operated pump according to the invention.

The pump shown in FIG. 1, and generally indicated with 10, comprises a hollow cylindrical body 11 provided at one of its ends with a support basis 12, which closes the said body 11 in correspondence of such an end. At its other end, the body 11 is provided with a cap 13 which is coupled by means of a screw-threading with the side wall of the same body; the cap 13 constitutes hence a removable end wall for body 11.

Inside the body 11, a plunger 14 is slidingly mounted, which divides the inner cavity of the same body into two variable-volume chambers 15 and 16.

The plunger 14 is actuated by means of an outer handle 17 through a stem 18 positioned along the axis of body 11, and rigidly constrained at its two ends respectively to the plunger 14 and to the handle 17.

Figure 2:
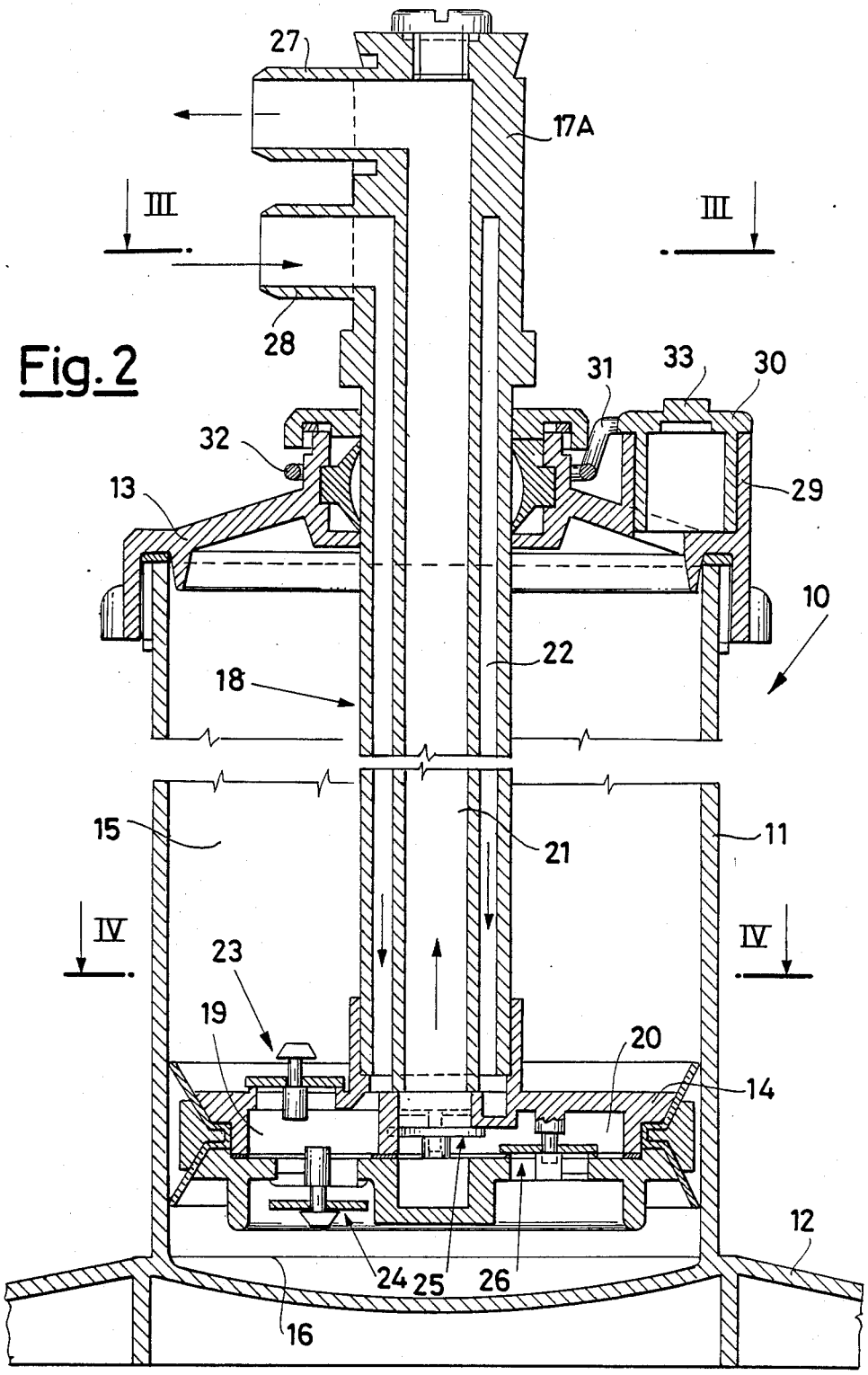
FIG. 2 is a totally sectional, enlarged view of the pump of FIG. 1, with an element thereof being turned by 90°.
Figure 3:
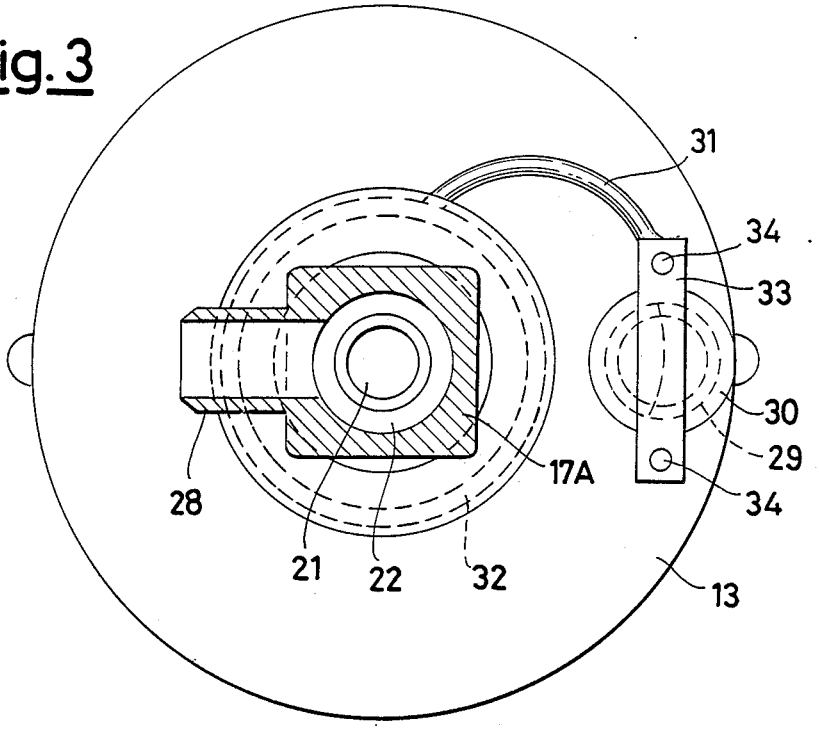
FIGS. 3, 4 are two sectional views of the pump of FIG. 1, respectively according to path III—III and IV—IV of FIG. 2.
Figure 4:
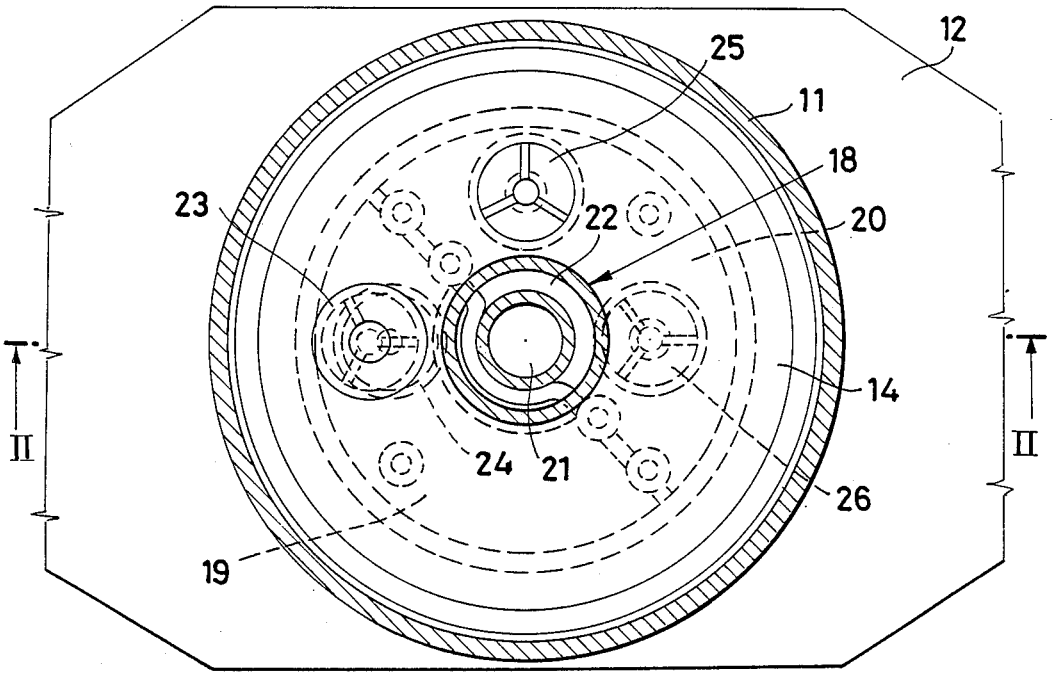

As shown in FIG. 2, inside the plunger 14 two separated chamber, 19 and 20, are provided. Correspondingly, inside the stem 18 two coaxial, mutually separated, channels 21 and 22 are provided, the first channel 21 being internal to the second channel 22. Channel 21 communicates with chamber 20; channel 22 communicates with chamber 19.

The plunger 14 is furthermore provided with four nonreturn valves, respectively indicated with 23, 24, 25, 26. Valve 23 places in communication, in a unidirectional way, chamber 19 with chamber 15; valve 24 places in communication, in a unidirection way, chamber 19 with chamber 16; valve 25 places in communication, in a unidirectional way, chamber 15 with chamber 20; finally, valve 26 places in communication, in a unidirectional way, chamber 16 with chamber 20.

The handle 17 is provided with a central portion 17A for the true connection with stem 18. Said portion 17A is provided with two openings 27 and 28 which are respectively in communication with channel 21 and channel 22, making these channels communicate with the outer environment.

The cap 13 is provided, it too, with an opening indicated with 29, which constitutes a passage for placing chamber 15 in communication with the outside. The opening 29 is tightly sealed by a plug 30. The opening 29 and the plug 30 are coupled to each other with elastic interference. Plug 30 is kept tied to cap 13 by means of a cord 31 which is connected, at one of its ends, with plug 30, and at its other end, with a collar 32 which surrounds a portion of cap 13, thus getting anchored to it.

The plug 30 comprises furthermore a grip portion 33 of long shape, provided with two bores 34; through one of said bores the end of a small string, or of any other equivalent means, can be passed and then knotted, said string being knotted, at its other end, to body 11, so to keep plug 30 anyway tied, in case of a breakage of either cord 31 or of collar 32, to same body of pump 10.

The disclosed pump operates as follows.

By moving upwards plunger 14 (to-stroke), valves 23 and 26 get closed, and valves 24 and 25 get opened, as shown in FIG. 2. In this way, outer air is intaken into chamber 16 through the opening 28, duct 22, chamber 19 and valve 24, while, at the same time, air contained inside chamber 15 is pushed towards opening 27 through valve 25, chamber 20 and duct 21.

Then, by moving plunger 14 downwards (fro-stroke), valves 24 and 25 get closed and valves 23 and 26 get opened. In this way, outer air is intaken into chamber 15, through opening 28, duct 22, chamber 19 and valve 23, while air contained inside chamber 16 is delivered, at the same time, towards opening 27, through valve 26, chamber 20 and duct 21.

Opening 27 is hence a delivery opening of pump 10, and opening 28 is a pump intake opening.

To the purpose of actuating plunger 14, the operator acts manually on handle 17, lifting and sinking it, while keeping pump 10 firmly fastened on the support plane, by pressing, by his feet, on two portions 12A and 12B of basis 12, which protrude transversely relatively to body 11.

When the delivery pressure is so high that the operator only succeeds in sinking plunger 14 by exploiting his own bodyweight, but is unable to lift it, i.e., he is in the critical situation as disclosed in the introduction, it is enough to remove plug 30 to the purpose of overcoming this drawback. In fact, by so doing, chamber 15 comes into direct communication with the outer environment, and in its to-stroke plunger 14 does not find any fluid resistance. Thus, the operator can lift, without any stresses, plunger 14.

Clearly, with the plug being extracted, the only useful stroke of pump 10 is the fro-stroke.

This is however particularly useful when, e.g., air tubes must be iflated of rubber boats; in fact, at the beginning a large air flowrate per unit of time is requested for filling the air tube with water, and at the end overcoming a high pressure corresponding to the boat operating pressure becomes necessary, and the flowrate per time unit is not much important.

To the purpose of placing the chamber 15 in communication with the outside, in the example an opening is suggested, integral with the pump body, and suitable to be tightly closed by a plug. Such a practical embodiment is very simple, with all of the consequent advantages. The plug can be coupled with the opening also by screw means or by spring means. Other equivalent means can be provided as well. For example, the cap can be equipped with a simple valve suitable to be controlled from the outside.

Figure 5:
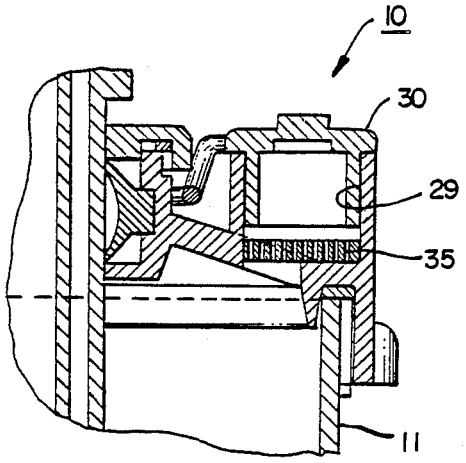
FIG. 5 is a sectional view of the pump of FIG. 1 in which a filter is located in a passageway.

FIG. 5 illustrates in a fragmentary side sectional view an embodiment of the invention in which a filtering element 35 is located inside the opening 29. The filtering element 35 may be inserted, to the purpose of avoiding that generic materials external to the pump may enter chamber 15. To the same purposes, a filtering element may be inserted inside openings 27 and 28.

Figure 6:
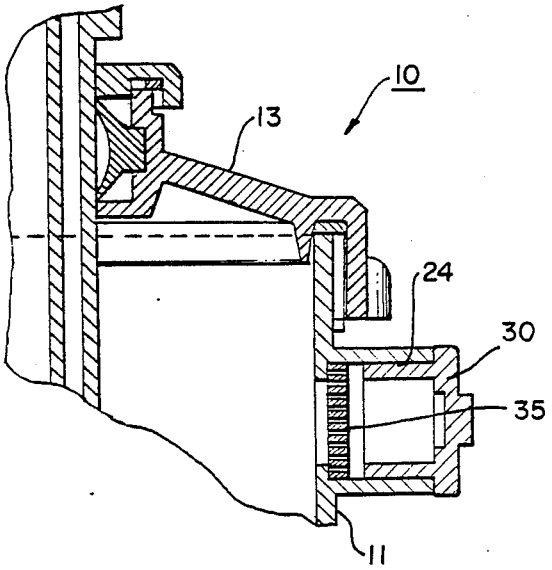
FIG. 6 is a sectional view of an alternative embodiment of the pump of FIG. 1 in which a passageway, a plug and filter are located in the sidewall of the pump body.

In FIG. 6 an alternative embodiment of the invention is illustrated in which the passage 29 for placing chamber 15 in communication with the outer environment can be provided also in the side wall of body 11 in the nearby of cap 13. In the embodiment illustrated in FIG. 6 the filtering element 35 is located in the opening 29.

Variants can be provided also as regards the layout of the intake and delivery channels, of intake and delivery openings and of nonreturn valves. Such elements may also be located inside the pump's body, even if the layout as shown shows to be economically favourable for the manufacturer, and also for the user, in case replacing pump components becomes necessary.

Also the general shape of the pump, as well as of its component elements may vary.

I claim:

1. A hand-operated pump changeable from double action to single action comprising: a hollow cylindrical body having a side wall; a plunger slidably positioned within the cylindrical side wall for dividing the interior of the body into a first variable volume chamber and a second variable volume chamber; each of said first and second variable volume chambers having a closed end wall; the body having a passage therein to the outside in communication with the first chamber; a pump comprising unidirectional valve means for controlling intake of fluid from the outside of the body into the chambers and from the inside of the chambers to outside the body; a handle, coupled to the plunger for reciprocally driving the plunger in opposite directions, including a to-stroke during which the handle is drawn away from the pump body and during which to-stroke the pump intakes fluid from the outside of the body into the second chamber, and in which fluid is delivered from the first chamber to the outside, and a fro-stroke in which the handle is urged towards the pump body and during which fro-stroke fluid is drawn in from the outside of the body into the first chamber and fluid is delivered from the second chamber to the outside; and normally closed means located in the passage for selectively venting the first chamber to the outside, when the passage is closed the pump operates with dual action on the to-stroke and the fro-stroke and when the passage is vented, the pump operates with single action on the fro-stroke.

2. Hand-operated pump according to claim 1, wherein said passage is provided in the closed end wall of the first chamber of said body.

3. Hand-operated pump according to claim 2, wherein said end wall is removable.

4. Hand-operated pump according to claim 1, wherein said passage is provided on a side wall of said body.

5. Hand-operated pump according to claim 1, wherein said passage is closed by a plug.

6. Hand-operated pump according to claim 5, wherein said plug is coupled with said passage with elastic interference.

7. Hand-operated pump according to claim 5, wherein constraint elements are provided for constraining the plug to the pump body.

8. Hand-operated plug according to claim 7, wherein said constraint elements comprise a collar anchored to the pump body, and a cord constrained at one of its ends to the plug, and at its other end, to the collar.

9. Hand-operated pump according to claim 1, wherein said passage has the shape of an opening.

10. Hand-operated pump according to claim 11, wherein inside said passage a filtering element is inserted.

11. Hand-operated pump according to claim 5, wherein said plug is provided with a grip portion provided with at least one bore.

12. Hand-operated pump according to claim 1, wherein said handle is connected to said plunger by means of a stem, and wherein said unidirectional valve means are provided in the plunger, inside said stem intake and delivery ducts being provided, which place said chambers in communication with the outside through said valve means.

* * * * *

UNITED STATES PATENT AND TRADEMARK OFFICE

CERTIFICATE OF CORRECTION

PATENT NO. : 4,842,489

DATED : June 27, 1989

INVENTOR(S) : Francesco Lucisano

It is certified that error appears in the above-identified patent and that said Letters Patent is hereby corrected as shown below:

Title page:

--Assignee: S.R.S. Lucisano F. & C. s.n.c. --

Signed and Sealed this

Twenty-sixth Day of June, 1990

*Attest:*

HARRY F. MANBECK, JR.

*Attesting Officer*

*Commissioner of Patents and Trademarks*